US005451338A

United States Patent [19]

Tokosh et al.

[11] Patent Number: 5,451,338

[45] Date of Patent: Sep. 19, 1995

[54] MAR RESISTANT SOAP FORMULATIONS

[75] Inventors: Richard Tokosh, Saddle Brook, N.J.; Ali Baig, Monroe, N.Y.

[73] Assignee: Avon Products, Inc., Suffern, N.Y.

[21] Appl. No.: 349,005

[22] Filed: Dec. 2, 1994

Related U.S. Application Data

[63] Continuation of Ser. No. 103,083, Aug. 6, 1993, abandoned.

[51] Int. Cl.[6] ..... C11D 9/00; C11D 9/24; C11D 9/26

[52] U.S. Cl. ..... 252/108; 252/132; 252/156; 252/174.17; 252/174.18; 252/DIG. 5; 252/DIG. 16

[58] Field of Search ..... 252/108, 132, 156, 174.17, 252/174.18, DIG. 16, DIG. 5

[56] References Cited

U.S. PATENT DOCUMENTS

| | | | |
|---|---|---|---|
| 1,991,501 | 2/1935 | Gettemuller et al. | 252/132 |
| 3,224,976 | 12/1965 | Farrar et al. | 252/DIG. 16 |
| 3,832,431 | 8/1974 | Matthaei | 264/75 |
| 3,940,220 | 2/1976 | D'Arcangeli | 425/131.1 |
| 4,121,904 | 10/1978 | Schamper | 8/161 |
| 4,137,302 | 1/1979 | Humbert et al. | 424/47 |
| 4,207,198 | 6/1980 | Kenkare | 252/117 |
| 4,328,131 | 5/1982 | Carson, Jr. | 252/542 |
| 4,424,234 | 1/1984 | Alderson et al. | 424/317 |
| 4,439,355 | 3/1984 | Kankare | 252/541 |
| 4,564,462 | 1/1986 | Watanabe et al. | 252/108 |
| 4,740,367 | 4/1988 | Force et al. | 424/47 |
| 4,762,642 | 8/1988 | Joshi et al. | 252/368 |
| 4,854,126 | 4/1989 | Joshi | 252/108 |
| 5,284,598 | 2/1994 | Subramanyam et al. | 252/121 |
| 5,312,559 | 5/1994 | Kacher et al. | 252/125 |
| 5,340,492 | 8/1994 | Kacher et al. | 252/112 |

*Primary Examiner*—Paul Lieberman
*Assistant Examiner*—Patricia Hailey
*Attorney, Agent, or Firm*—Hopgood, Calimafde, Kalil & Judlowe

[57] ABSTRACT

Soap formulations are made by incorporating a selected monohydric alcohol and suitable superfatting agents into high moisture molten soap. These formulations eliminate the formation of marring problems which are described as undesirable, white, chalk-like shatter marks and dents normally associated with handling, shipping and distribution to customers.

13 Claims, No Drawings

MAR RESISTANT SOAP FORMULATIONS

This application is a continuation of application Ser. No. 08/103,0 filed on Aug. 6, 1993, now abandoned.

FIELD OF THE INVENTION

The present invention relates to soap formulations, specifically a molten base which incorporates a selected high molecular weight, monohydric alcohol and preferred superfatting agents to produce non-marring soaps.

BACKGROUND OF THE INVENTION

Gift and decorative soaps are commercially manufactured in a variety of aesthetically pleasing configurations. These products are frequently damaged by marring which is defined as the formation of undesirable, white, chalk-like shatter marks in and around dented areas on conventional soaps. Marring typically results from handling, shipping and distribution of finished product to customers.

Approximately one to two weeks after soap bar preparation, ordinary gift and decorative soaps bruise and chip especially on the edges and corners of intricate or unique configurations. When soap products are packed side-by-side, marring often occurs because individual bars bump against each other or against carton partitions and side walls. This marring is readily noticed, especially with colored soap where the chalk-like marks form around the bruises and chips.

Labor intensive packaging processes are currently used to protect conventional soap bases against marring. Novelty products which depend heavily on aesthetically pleasing qualities have previously required expensive cartons and/or protective wrappings to prevent surface defects. Even with these extra precautions, there is no guarantee that conventional formulations will avoid surface defects.

The present disclosure describes processes and formulations which eliminate marring problems by incorporating at least one high molecular weight, monohydric alcohol and superfatting agents into high moisture molten base soap, otherwise known as neat soap. In another embodiment, the high molecular weight, monohydric alcohol can be replaced with relatively higher proportions of other ingredients that comprise the present composition, especially the coconut fatty acid component. Utilization of these novel soap bases reduces production costs by eliminating the need for expensive packaging and handling operations.

According to the present invention, about 75% to about 90% of a sodium soap composition is derived from tallow and the remainder is derived from vegetable sources such as coconut oil, palm oil, palm kernel oil, babassu oil or mixtures thereof. Unless otherwise stated, all fractional amounts are expressed in weight percent. Conventional soap bars containing similar percentages of tallow and coconut oil are characterized by marring problems.

It is an object of the present invention to provide a soap bar with about 75% to about 90% sodium soap derived from tallow and vegetable oil.

Another object of the present invention is to provide a mar-resistant soap composition which eliminates the need for protective packaging.

It is a further object of this invention to provide soaps with extended resistance to marring even after lengthy storage and shelf-life.

Still another object of this invention is to provide a mar-resistant soap composition which can be produced on conventional soap-making apparatus.

These and other objects and advantages are achieved by the invention described below.

SUMMARY OF THE INVENTION

The preferred mar-resistant soap of the present invention is a soap bar prepared by milling or continuous extrusion. A typical composition includes the following ingredients:

(a) from about 72% to about 82% sodium soap, wherein said sodium soap is derived from about 75% to about 90% tallow and the remainder is derived from coconut oil, (b) from about 5.0% to about 9.0% glycerin, (c) from about 1.0% to about 3.0% petrolatum, (d) from about 1.0% to about 3.0% alkoxylated cetyl alcohol, (e) from about 0.1% to about 0.5% coconut fatty acids, and (f) from about 7.0% to about 12.0% by weight water.

Soap derived from tallow is present at a level of about 85% with the remainder derived from coconut oil. This component is listed as a non-limiting example, as other vegetable source oils such as palm oil, palm kernel oil, babassu oil or mixtures thereof can be substituted with similar results.

The term "soap ingredient" includes minor amounts of salt such as sodium chloride or preservatives which are frequently present and can be considered part of soap. The weight percentage of sodium soap expressed above does not include glycerin because it is considered part of the glycerin ingredient described below.

Glycerin helps processability of the final formula and adds to the "no-mar" characteristics. The lower limit is 5%. Use of less glycerin has a negative effect on mar-resistance. If the upper limit of about 9.0% is exceeded, processability can be negatively affected. Glycerin is preferred, but other ingredients such as isopropyl palmitate or isopropyl myristate will achieve similar results.

The petrolatum component also contributes to the no-mar properties. A decrease in the amount of petrolatum from the lower limit of about 1.0% detracts from resistance to marring. An increase in petrolatum over the upper limit of about 3.0% can cause the composition to become sticky and have a negative effect on processability.

Alkoxylated cetyl alcohol (available from Croda Inc. under the trade name Procetyl AWS) provides no-mar properties and facilitates processing of the product. This ingredient is a high molecular weight monohydric alcohol with the following formula:

$$R-CH_2-(O\underset{\underset{CH_3}{|}}{C}HCH_2)_x-(OCH_2CH_2)_y-OH \qquad (I)$$

where R is the cetyl (hexadecyl) radical $C_{16}H_{33}$—, X is the integer 5 and Y is the integer 5.

Alkoxylated cetyl alcohol is a mixed polyether produced by reacting cetyl alcohol with 5 moles of propylene oxide, followed by reaction with 20 moles of ethylene oxide. Suitable alternatives include saturated or unsaturated alcohols of fatty acids, or their mixtures, such as those having between 14 to 22 carbons (myristoyl to behenolyl alcohols) with between 3 to 10 moles of propylene oxide and 20 to 50 moles of ethylene oxide.

A decrease in the amount of alkoxylated cetyl alcohol from the lower limit of about 1.0% detracts from processability and resistance to marring. Optimum processability can be achieved with up to 3.0%. Greater amounts of alkoxylated cetyl alcohol may produce a sticky composition with inferior processability.

As for the water content, if the upper limit of about 12.0% is exceeded, the composition can become sticky and soft, affecting processability. Maintaining at least 8.0% water is important for migration of the composition through extrusion equipment.

In the preferred embodiment expressed above, the primary function of the coconut fatty acid is to neutralize the free alkalinity of the soap base and to aid in the no-mar characteristics of the bar. A decrease in the amount of coconut fatty acid from the lower limit of 0.1% will have a negative effect on the ability to neutralize alkalinity and detract from the mar-resistance of the formula. Levels over 1.0% can have a negative effect on the processing characteristics of the bar.

In another embodiment expressed below, the alkoxylated cetyl alcohol can be eliminated if greater amounts of coconut fatty acids are added. Soap bars within the scope of this embodiment include those which comprise the following composition:

(a) from about 72% to about 82% sodium soap, wherein said sodium soap derived from about 75% to about 90% tallow and the remainder derived from coconut oil, (b) from about 5.0% to about 9.0% glycerin, (c) from about 1.0% to about 3.0% petrolatum, (d) from about 1.0% to about 5.0% coconut fatty acids, and (e) from about 7.0% to about 12.0% water.

The present soap compositions can be colored without detracting from their no-mar properties. While many soap bars are white, color is often desirable to enhance the aesthetic value of the product. This is accomplished by the adding of minor amounts of colorants. These amounts and colorants are well-known in the soap making art.

DETAILED DESCRIPTION OF THE INVENTION

The soap bars of this invention are readily prepared by using conventional soap-making equipment. For example, a preferred method is to produce sodium soap in a Mazzoni "SC" plant. The resulting neat soap (approximately 32% moisture) is then transferred to a holding tank. Before transfer to a heat exchanger, glycerin, petrolatum, alkoxylated cetyl alcohol and coconut fatty acid are injected into the molten neat soap. Appropriate amounts are disclosed in this specification.

The resulting combination is dried in a Mazzoni spray dryer and the water level is adjusted to desired proportions. Storage hoppers collect the composition in the form of noodles. This base product is then added to an amalgamator, where colorants and perfume are admixed. The resulting combination is converted to a homogeneous composition by extruding through two Mazzoni simplex plodders fitted with screens (0.1mm to 3.0mm). A Mazzoni duplex plodder then extrudes the composition under vacuum into a continuous bar or log. Each log is cut into billets which are shaped into the desired configuration on a soap press.

Those skilled in the art could adapt the above procedure to obtain the no-mar soap of the present invention. These adaptations are within the scope and spirit of the present disclosure. For example, the ingredients can be "crutched" to form the desired composition and roller mills can be used in place of the continuous extrusion process. The following examples are presented to illustrate the no-mar properties of the present invention.

EXAMPLE I

FORMULA: NM-3

| Ingredient | Percentages |
|---|---|
| Sodium soap (85% derived from tallow acid and 15% derived from coconut acid) | 78.3 |
| Water (moisture) | 9.0 |
| Glycerin | 7.8 |
| Petrolatum | 2.1 |
| Alkoxylated cetyl alcohol | 2.1 |
| Coconut Fatty Acid | 0.3 |
| Sodium Chloride | 0.4 |

Weight percentages were measured directly after drying. The bars of the above composition were made by reacting tallow/coconut fatty acid with sodium hydroxide in a Mazzoni "SC" continuous neutralization plant. During reaction, a sodium chloride/water solution was added to facilitate processing of the final product, along with antioxidants to prolong stability. Final concentrations of the sodium chloride and antioxidants in the neat soap were 0.35% and 0.05%, respectively.

After the neat soap was formed, the composition was pumped into a holding tank. Before introduction to the heat exchanger, an appropriate amount of glycerin, petrolatum, alkoxylated cetyl alcohol and coconut fatty acid were metered into the neat soap. Temperature was then increased in the heat exchanger. The moisture of this hot composite was reduced from about 32% to about 7.0%–10.0% in the Mazzoni spray dryer. Dried composite was formed into noodles by extruding through a simplex plodder; and the noodles were subsequently transferred to storage hoppers.

From the storage hoppers the soap was weighed into an amalgamator. Colorants and perfume were added and mixed for five minutes. The composite was fed through simplex plodders fitted with screens (from about 0.1mm to 3.0mm) to form a homogeneous mass which was extruded under vacuum in a Mazzoni duplex plodder to produce a continuous bar. The continuous bar was automatically cut into suitable sized billets which were pressed into finished bars of unique decorative configurations (such as bells and tree shapes as described below).

Test bars were aged for one month at 110° F. to simulate a one year shelf life. The bars were comparatively tested for color, fragrance and shape with controls prepared from Armour Plastibar base (available from the Dial Corp. and further described in Example IV). Results are described below.

EXAMPLE II

As stated above, the alkoxylated cetyl alcohol can be eliminated provided a greater amount of coconut fatty acids is added to the composition. Exemplary soap bars were made as follows:

| FORMULA: NM-6 | |
|---|---|
| INGREDIENT | PERCENTAGE |
| Sodium soap (85% derived from tallow acid and 15% derived from coconut acid) | 76.8 |
| Water (moisture) | 9.0 |
| Glycerin | 7.8 |
| Coconut Acids | 3.9 |
| Petrolatum | 2.1 |
| Sodium Chloride | 0.4 |

Processing conditions were the same as described in Example I.

EXAMPLE III

Jojoba oil was used in a soap preparation which contained no alkoxylated cetyl alcohol. The purpose was to determine whether an oil/waxy type additive could provide no-mar characteristics when substituted for alkoxylated cetyl alcohol. The results, from the comparative examples which follow, show that jojoba oil provides inadequate no-mar properties. Tested soap bars contained the following composition:

| FORMULA: NM-11 | |
|---|---|
| INGREDIENT | PERCENTAGE |
| Sodium soap (85% derived from tallow acid and 15% derived from coconut acid) | 81.5 |
| Water (moisture) | 9.0 |
| Glycerin | 7.8 |
| Jojoba Oil | 1.0 |
| Sodium Chloride | 0.4 |
| Coconut Acids | 0.3 |

Processing conditions were the same as described in Example I.

EXAMPLE IV

Comparative controls were prepared from Armour Plastibar soap base pellets according to a formula supplied in publicly available trade literature. These soap bars contained the following composition:

| FORMULA: CONTROL | |
|---|---|
| INGREDIENT | PERCENTAGE |
| Fatty acid | (% not disclosed) |
| Water (moisture) | 13.5 |
| Glycerin | 7.0 |
| Sodium Chloride | 0.5 |
| Sodium hydroxide (free alkalinity) | 0.04 |
| Pentasodium pentatate | 0.06 |
| Tetrasodium etidronate | 0.06 |

Processing conditions were the same as described in Example I.

Testing was carried out by a number of procedures indicated in the following examples. In one test, the flat edge of an operator's fingernail was simply drawn across the panel surface of the bar. Comparative tests on colored soap bars with no resistance to marring showed a white mark, while colored soap bars characterized by good resistance to marring showed no visible marks. Another test used corners of test bars which were bumped against hard flat surfaces or sharp edges of countertops and laboratory tables. Conventional soap bars, tested at least one to two weeks after preparation, chipped and formed powdery white dust at the points of impact. Soap bars with good resistance to marring did not chip and had virtually no whiteness around the bruised areas.

Vibration and drop tests were also conducted. Fully packed cases were energized on a vibration table or dropped from a designated height. Conventional soap bars, tested at least one to two weeks after preparation, formed white dust powder and chipped at points of contact with the carton. Soap bars characterized by good resistance to marring showed little or no powder or chipping. For the packaging test, bars were formed into bell and tree ornamental shapes.

EXAMPLE V

The formulations tested for the control and experimental products were as follows:

| INGREDIENTS | PERCENTAGE |
|---|---|
| BELL SHAPE | |
| Soap Base* | 96.932 |
| Titanium Dioxide | 0.500 |
| Pigment Green #7 | 0.060 |
| Cosmetic Red Oxide | 0.008 |
| Pigment Yellow #1 | 0.500 |
| Fragrance | 2.000 |
| PINE TREE SHAPE | |
| Soap Base* | 96.932 |
| Titanium Dioxide | 0.500 |
| Pigment Green #7 | 0.060 |
| Cosmetic Red Oxide | 0.008 |
| Pigment Yellow #1 | 0.500 |
| Fragrance | 2.000 |

*The soap bars were prepared from NM-3 (Example I), NM-6 (Example II) and NM-11 (Example III). The control was prepared from Plastibar base (Example IV).

Standard packaging test methods were used to evaluate the no-mar properties of the formulations. Specifically, fresh product (stored at ambient temperature for one week) and aged product (stored at 110° F. for one month) were tested for vibration and drop testing.

In the vibration test (Tables I and II, #40.018) the product was evaluated to determine the ability of finished goods to withstand the simulated vibrations of transportation. This method was also used to determine the adequacy of the formulation to resist marring. Full cases of the control and experimental formulations were placed on a vibration table capable of generating acceleration levels of 0.5 G and a frequency of 250 rpm or 8 cps.

The test procedure is described below.

Examine all samples. Mark damaged samples and record observations.

Re-assemble all samples as described in the Package Profile, National Bill of Material or as specified by the responsible Package Development Engineer. Replace in exact position as received.

Pack samples, pads, liners or other protective pieces. Close and seal packer.

Weigh packer and record weight.

Place the packer on the vibration equipment. Do not fasten samples to each other or to the table.

Set the control for ½ inch displacement.

Set frequency control at 0. Slightly increase frequency until a piece of material, about 0.010 inch thick, can can be slid under the edge of the test load and the table. This is an indication that the acceleration of 0.5G has been reached. 0.5G is the maximum tolerable acceleration level encountered in normal transportation environment.

Check samples for marring (white flaking and scuffing) after 3 hours of vibration.

The drop test method (Table I, #40.019 and #40.054) was used to determine the ability of finished goods to withstand the simulated shocks of handling and transportation. This method was also used to determine the adequacy of the formulation to resist marring. The apparatus was a variable height drop tester with a range of 18"–48" and a release mechanism that did not interfere with free unobstructed fall. This test was conducted with the following protocol.

Examine all samples. Mark damaged samples and record observations.

Re-assemble all samples as described in the Package Profile, National Bill of Material or as specified by the responsible Package Development Engineer.

Pack samples, pads, liners or other protective pieces. Close and seal packer.

Weigh packer and record weight. Maximum weight is 50 lbs. for Avon packers.

Set equipment for a drop height of 30 inches.

Identify faces by placing the container with top and manufacturer's joint on the right. Face 1 is the bottom, Face 2 is the left side, Face 3 is the top and Face 4 is the near side.

Separately drop the container on Face 1, Face 2, Face 3 and Face 4. Record results.

No-mar properties were also evaluated for withstanding simulated vibrations from transportation in a representative order tray (Table II, #40.053). Representative orders were subjected to forces and vibrations present in over the road shipping conditions or distribution cycles that can adversely affect the appearance of finished product.

A minimum of six samples were tested in standard trays. The total weight of the tray was 7 lbs. with 20 standard items along with the test items. The tray was assembled to simulate methods of handling and packing common in the industry, according to the following procedure.

Examine all samples. Mark damaged samples and record observations.

Prepare representative trays in a manner that simulates the current method of branch handling and packing. Tray will weigh 7 lbs. each and have 20 items along with the test items.

Close and seal the representative tray.

Weigh trays and record weights.

Place the packers on the vibration table.

Set the control for ½ inch vibration displacement.

Set frequency control at 0. Slightly increase frequency until a piece of material, about 0.010 inch thick,can be slid under the edge of the test load and the table. This is an indication that 0.5 G acceleration has been reached.

Check soap samples after three hours for signs of marring.

Mark marring on soap samples and record results.

Representative orders were also drop tested. Table I, #40,054, demonstrates the no-mar properties when finished product is subjected to the simulated shocks of handling and transportation in a standard tray.

Examine all samples. Mark damaged samples and record observations.

Prepare representative trays in a manner that simulates the current method of branch handling and packing. Tray will weigh 7 lbs. each and have 20 items along with the test items.

Close and seal the representative tray.

Set the equipment for a drop height of 30 inches.

Place the tray on release mechanism on a conventional manner. Face 1 is the bottom, Face 2 is the left side, Face 3 is the top and Face 4 is the near side.

Sequentially drop the tray on Face 1, Face 2, Face 3 and Face 4.

Results on one week old bars stored at ambient temperature are set forth below in Table I.

TABLE I

| | NM3 | NM6 | NM11 | Control |
|---|---|---|---|---|
| 40.018 - VIBRATION | | | | |
| Slight Scuff | 35/39 | 18/39 | 23/39 | 30/39 |
| SL/Moderate | 03 | 04 | 16 | 09 |
| Moderate | 00 | 03 | 00 | 00 |
| 40.019 - DROP | | | | |
| Satisfactory | 21 | 14 | 17 | 26 |
| SI Denting | 13 | 14 | 12 | 13 |
| SI/Mod Denting | 03 | 05 | 09 | 00 |
| Mod Denting | 01 | 05 | 01 | 00 |
| 40.053 - VIBRATION | | | | |
| Slight Scuff | 12 | 12 | 12 | 11 |
| SI/Mod Scuff | 00 | 00 | 00 | 01 |
| 40.054 - DROP | | | | |
| Satisfactory | 03 | 06 | 06 | 00 |
| SI. Denting | 06 | 05 | 03 | 07 |
| SI/Mod Denting | 02 | 01 | 03 | 05 |
| Mod Denting | 01 | 01 | 00 | 00 |

NM3 and NM6 appear equivalent with respect to no-mar characteristics, with NM6 being slightly favored numerically. Both formulas are significantly better than NM11 and the control samples. Results on products aged at 110° F. for one month are shown below in Table II.

TABLE II

| | NM3 | NM6 | NM11 | Control |
|---|---|---|---|---|
| 40.018 - VIBRATION & DROP | | | | |
| Slight Scuff | 6/35 | 6/35 | 16/35 | 5/35 |
| SL/Moderate | 0/35 | 3/35 | 4/35 | 0/35 |
| Moderate | 0/35 | 0/35 | 9/35 | 0/35 |
| 40.053 - REP TRAY | | | | |
| Slight Scuff | 7/12 | 6/12 | 2/12 | 4/12 |
| SL/Moderate | 0/12 | 1/12 | 5/12 | 0/12 |
| Moderate | 0/12 | 0/12 | 1/12 | 0/12 |
| Severe | 0/12 | 0/12 | 1/12 | 0/12 |

Full packer transit tests show that NM-3 is slightly better than NM-6. NM-11 did relatively poorly. Standard tray transit tests show very similar results. NM-3 and NM-6 are almost equal with respect to scuffing. NM-11 has inferior scuff characteristics.

Various modifications and alterations to the present invention may be appreciated based on a review of this disclosure. These changes and additions are intended to be within the scope and spirit of this invention as defined by the following claims.

What is claimed is:

1. A mar-resistant soap bar formulation comprising:

(a) from about 72% to about 82% sodium soap, (b) a mar-resistance enhancing amount of from about 5.0% to about 9.0% polyhydric alcohol, (c) a mar-resistance enhancing amount of from about 1.0% to about 3.0% petrolatum, (d) a mar-resistance enhancing amount of from about 1.0% to about 3.0% liquid monohydric alcohol, (e) a mar-resistance enhancing amount of from about 0.1% to about 0.5% coconut fatty acids, and (f) from about 7.0% to about 12.0% water.

2. The mar-resistant soap formulation of claim 1, wherein said sodium soap is derived from about 75% to about 90% tallow and from about 10% to about 25% vegetable oil.

3. The mar-resistant soap formulation of claim 2, wherein said vegetable oil is selected from the group consisting of coconut oil, palm oil, palm kernel oil, babassu oil and compatible mixtures thereof.

4. The mar-resistant soap formulation of claim 3, wherein said vegetable oil is coconut oil.

5. The mar-resistant soap formulation of claim 1, wherein said polyhydric alcohol is glycerin.

6. The mar-resistant soap formulation of claim 1, wherein said monohydric alcohol is alkoxylated cetyl alcohol.

7. The mar-resistant soap formulation of claim 1, wherein said monohydric alcohol is an alkoxylated, high molecular weight, saturated or unsaturated alcohol of a fatty acid having between 14 to 22 carbons.

8. A mar-resistant soap formulation comprising:

(a) from about 72% to about 82% of sodium soap, wherein said sodium soap is derived from about 75% to about 90% tallow and from about 10% to about 25% coconut oil, (b) a mar-resistance enhancing amount of from about 5.0% to about 9.0% glycerin, (c) a mar-resistance enhancing amount of from about 1.0% to about 3.0% petrolatum, (d) a mar-resistance enhancing amount of from about 1.0% to about 3.0% alkoxylated cetyl alcohol, (e) a mar-resistance enhancing amount of from about 0.1% to about 0.5% coconut fatty acids, and (f) from about 7.0% to about 12.0% water.

9. A mar-resistant soap bar formulation comprising:

(a) from about 72% to about 82% sodium soap, (b) a mar-resistance enhancing amount of from about 5.0% to about 9.0% polyhydric alcohol, (c) a mar-resistance enhancing amount of from about 1.0% to about 3.0% petrolatum, (d) a mar-resistance enhancing amount of from about 1.0% to about 5.0% coconut fatty acids, and (e) from about 7.0% to about 12.0% water.

10. The mar-resistant soap formulation of claim 9, wherein said sodium soap is derived from about 75% to about 90% tallow and from about 10% to about 25% vegetable oil.

11. The mar-resistant soap formulation of claim 10, wherein said vegetable oil is selected from the group consisting of coconut oil, palm oil, palm kernel oil, babassu oil and compatible mixtures thereof.

12. The mar-resistant soap formulation of claim 11, wherein said vegetable oil is coconut oil.

13. A mar-resistant soap bar formulation comprising:

(a) from about 72% to about 82% by weight of sodium soap, wherein said sodium soap is derived from about 75% to about 90% tallow and from about 10% to about 25% coconut oil, (b) a mar-resistance enhancing amount of from about 5.0% to about 9.0% glycerin, (c) a mar-resistance enhancing amount of from about 1.0% to about 3.0% petrolatum, (d) a mar-resistance enhancing amount of from about 1.0% to about 5.0% coconut fatty acids, and (e) from about 7.0% to about 12.0% water.

* * * * *